US007777680B2

(12) United States Patent
Abe et al.

(10) Patent No.: US 7,777,680 B2
(45) Date of Patent: Aug. 17, 2010

(54) ELECTRONIC APPARATUS AND TIMEPIECE

(75) Inventors: Kazuaki Abe, Iruma (JP); Kaoru Someya, Kiyose (JP); Soh Kimura, Kodaira (JP)

(73) Assignee: Casio Computer Co., Ltd., Tokyo (JP)

( * ) Notice: Subject to any disclaimer, the term of this patent is extended or adjusted under 35 U.S.C. 154(b) by 224 days.

(21) Appl. No.: 11/904,331

(22) Filed: Sep. 26, 2007

(65) Prior Publication Data

US 2008/0080320 A1 Apr. 3, 2008

(30) Foreign Application Priority Data

Sep. 29, 2006 (JP) ..... 2006-267790
Dec. 28, 2006 (JP) ..... 2006-354401
Jun. 28, 2007 (JP) ..... 2007-170527

(51) Int. Cl.
*H01Q 1/12* (2006.01)
*H01Q 7/08* (2006.01)

(52) U.S. Cl. ..... 343/718; 343/788

(58) Field of Classification Search ..... 343/787, 343/788, 718

See application file for complete search history.

(56) References Cited

U.S. PATENT DOCUMENTS 5,253,226 A 10/1993 Ganter
6,927,739 B2 * 8/2005 Nomura et al. ..... 343/788
7,274,337 B2 * 9/2007 Takakura ..... 343/788
7,280,438 B2 * 10/2007 Fujisawa ..... 368/47
7,511,679 B2 * 3/2009 Araki et al. ..... 343/788
2006/0066498 A1 3/2006 Abe et al.
2008/0007474 A1 1/2008 Abe et al.

FOREIGN PATENT DOCUMENTS

DE 39 41 913 C1 2/1991
DE 91 11 096.3 U1 1/1993
DE 44 07 116 A1 9/1995
JP 2004-294258 A 10/2004

OTHER PUBLICATIONS

Extended European Search Report dated Oct. 2, 2009 issued in counterpart European Appln. No. 07 01 8858.

* cited by examiner

*Primary Examiner*—Hoang V Nguyen
(74) *Attorney, Agent, or Firm*—Frishauf, Holtz, Goodman & Chick, P.C.

(57) ABSTRACT

In an antenna device of a wristwatch, a pair of external magnetic members each attached to a respective one of both ends of a magnetic core effectively collects the magnetic flux of a standard time and frequency signal. The collected magnetic flux passes through the core around which a coil is wound, thereby inducing an electromotive force and hence improving the reception accuracy of the signal. The pair of external magnetic members screens out undesirable external magnetism which would otherwise influence motors that drive a hand shaft and hands, thereby achieving accurate hand driving and improving the high watch accuracy.

6 Claims, 11 Drawing Sheets

ELECTRONIC APPARATUS AND TIMEPIECE

CROSS-REFERENCE TO RELATED APPLICATIONS

This application is based upon and claims the benefit of priority from prior Japanese Patent Applications No. 2006-267790, filed Sep. 29, 2006; No. 2006-354401, filed Dec. 28, 2006; and No. 2007-170527, filed Jun. 28, 2007, the entire contents of all of which are incorporated herein by reference.

BACKGROUND OF THE INVENTION

1. Field of the Invention

The present invention relates to an electronic apparatus and more particularly to an electronic timepiece whose time is set in accordance with a standard time and frequency signal.

2. Description of the Related Art

As one type of electronic apparatus, radio-controlled watches are known which receive the standard time and frequency signal and set the current times thereof automatically in accordance with the signal. In such watches, antennas that include a core made of ferrite or an amorphous magnetic material around which a coil is wound are widely used to receive the signal.

With a watch in which a motor drives the hands, the hand driving can be influenced by external magnetism undesirable for control of the watch, thereby reducing the time accuracy. In order to avoid such a situation, an anti-magnetic plate is provided within the case to screen out the external magnetism. Such anti-magnetic measures are also required even in radio-controlled watches having a hand-driving structure similar to that of general watches in order to maintain the watch accuracy.

The radio-controlled watch receives the standard time and frequency signal including time information, extracts the time information, sets the internal time thereof based on the time information, and then displays an accurate time. Thus, if the whole movement including the motor is covered with an anti-magnetic plate that screens out the external magnetism, it is, in turn, difficult to receive the standard time and frequency signal and hence the reception capacity may be possibly reduced.

In order to prevent a reduction in the reception capacity, an electronic watch has been proposed in which the movement including the motor is covered with an anti-magnetic plate with an opening through which a coil-bearing magnetic part of an antenna is exposed outside (see, for example, Published Unexamined Japanese Patent Application 2004-294258).

With this arrangement, a wide range of the case is covered with the anti-magnetic plate. Therefore, compared to the watch in which the anti-magnetic plate covers the coil bearing part of the antenna, the reception is somehow improved, but convergence of the magnetic flux of the received radio waves on the antenna is limited by the anti-magnetic plate. Hence, a great improvement of the reception cannot be expected.

It is therefore an object of the present invention to provide an electronic apparatus and timepiece free from influence of undesirable external magnetism and having high reception accuracy of the standard time and frequency signal.

BRIEF SUMMARY OF THE INVENTION

According to one aspect of the invention, an electronic apparatus comprises, within a body, at least one motor and an antenna device that comprises a magnetic body and a coil wound around the magnetic body. The magnetic body comprises a coil-bearing part around which the coil is wound, and a pair of coil-free parts each protruding outward from a respective one of ends of the coil bearing part. And, at least one of the pair of coil-free parts includes an extension for screening out external magnetism which would otherwise influence the at least one motor and for collecting magnetic flux of external radio waves.

According to another aspect of the invention, an electronic apparatus comprises at least one motor and an antenna device that comprises a magnetic core having a pair of ends and a coil wound around the core between its pair of ends. The core has, at at least one of the pair of ends, an external magnetic member including a connection part connected magnetically to that end and a flux collecting part that collects the magnetic flux of external radio waves and that screens out external magnetism which would otherwise influence the at least one motor.

According to further aspect of the invention, an electronic timepiece comprises an analog hand mechanism, a motor for driving the hand mechanism, and an antenna device that comprises a magnetic core and a coil wound around the core. The antenna device comprises an external magnetic member having a connection part connected magnetically to an end of the core, and a magnetic flux collecting part for screening out external magnetism which would otherwise influence the motor and for collecting the flux of external radio waves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention and, together with the general description given above and the detailed description of the embodiments given below, serve to explain the principles of the invention.

DETAILED DESCRIPTION OF THE INVENTION

Figure 1:
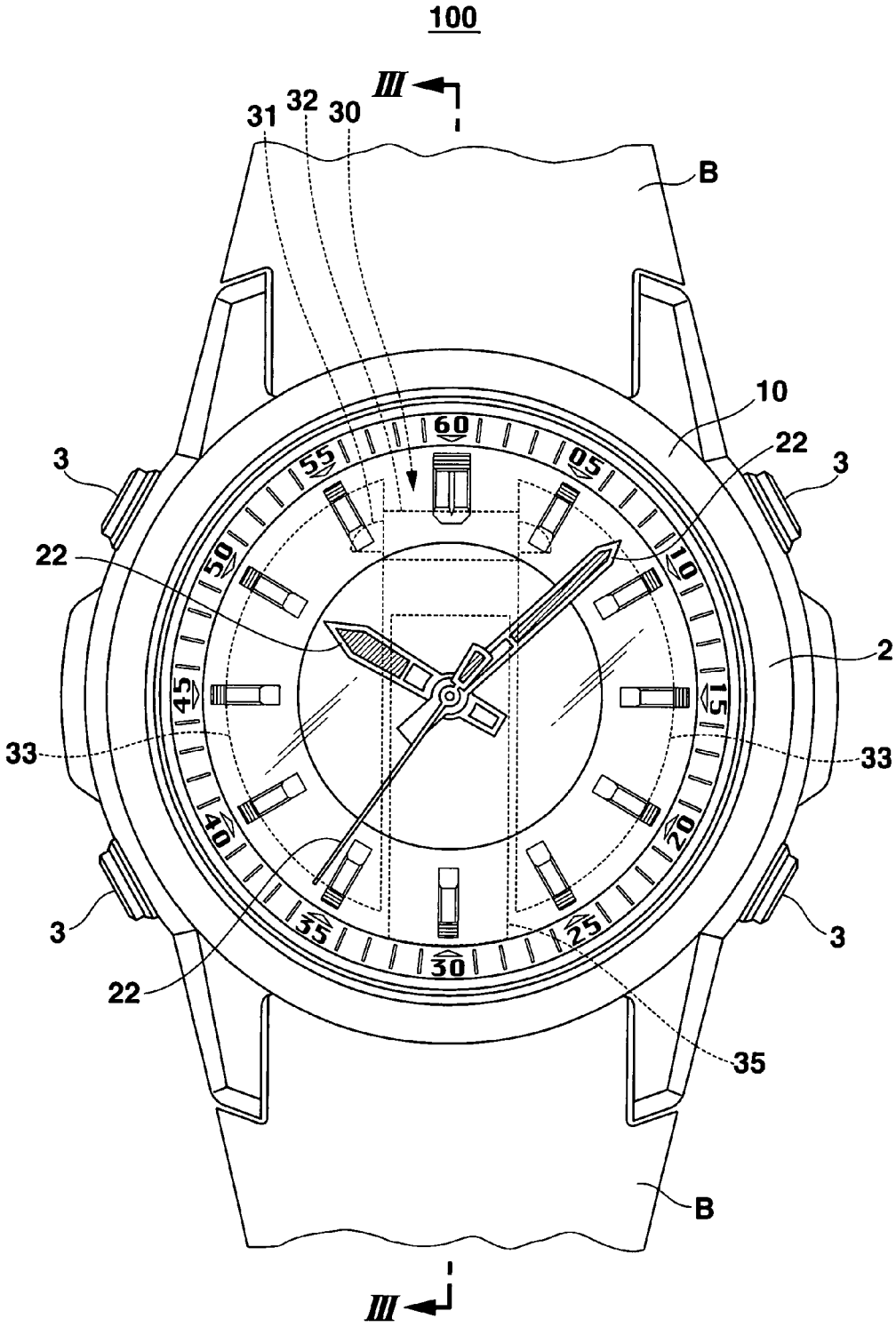
FIG. 1 is a front view of a wristwatch as an embodiment 1 of an electronic apparatus according to the present invention.

Now the present invention will be described specifically with respect to its embodiments and modifications, using the accompanying drawings. The same reference numerals denote like parts in all the Figures.

Embodiment 1

Figure 3:
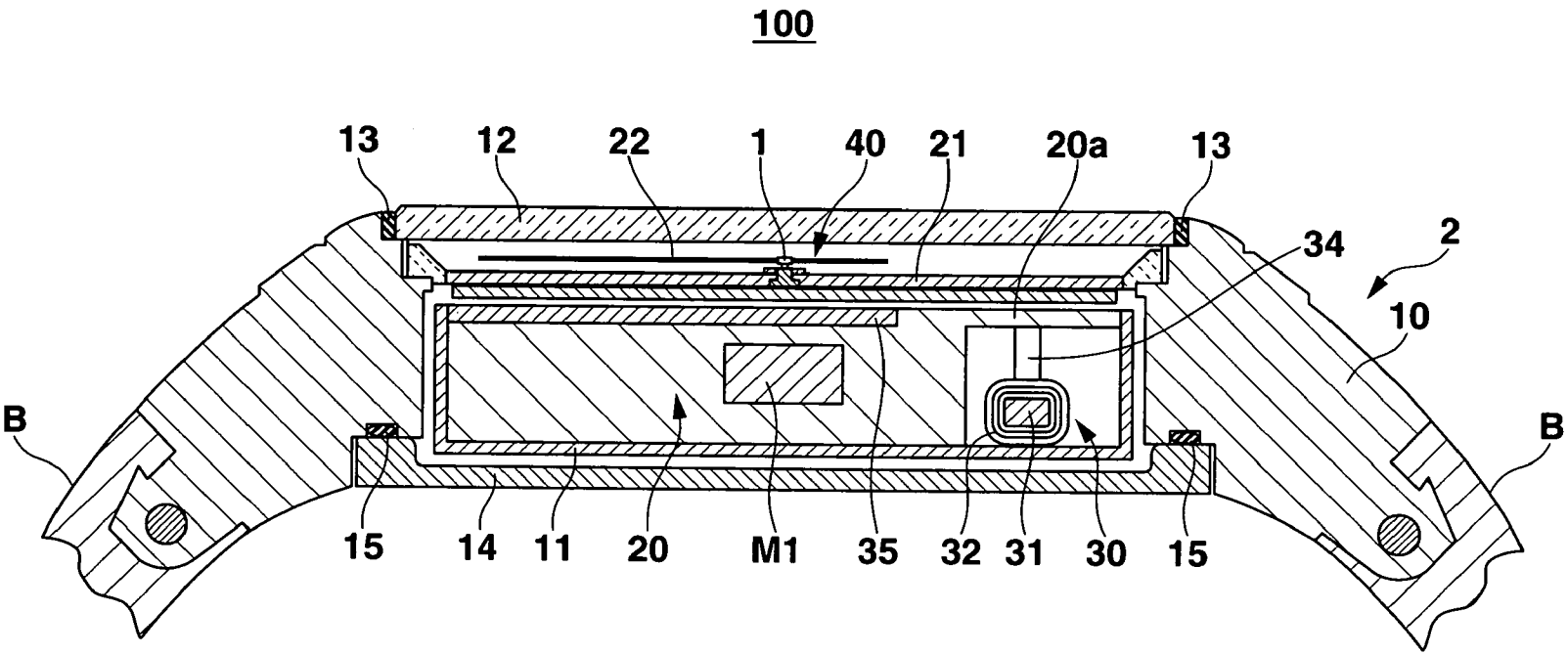
FIG. 3 is a cross section view taken along a line III-III of FIG. 1.

As shown in FIGS. 1 and 3, the wristwatch 100 has a body 2 with a band B whose ends are attached to the opposite ends of the body at 12 and 6 o'clock.

A plurality of switches 3 is provided along the outer periphery of the body 2 to give the respective elements concerned of the wristwatch commands to perform their functions.

Figure 2:
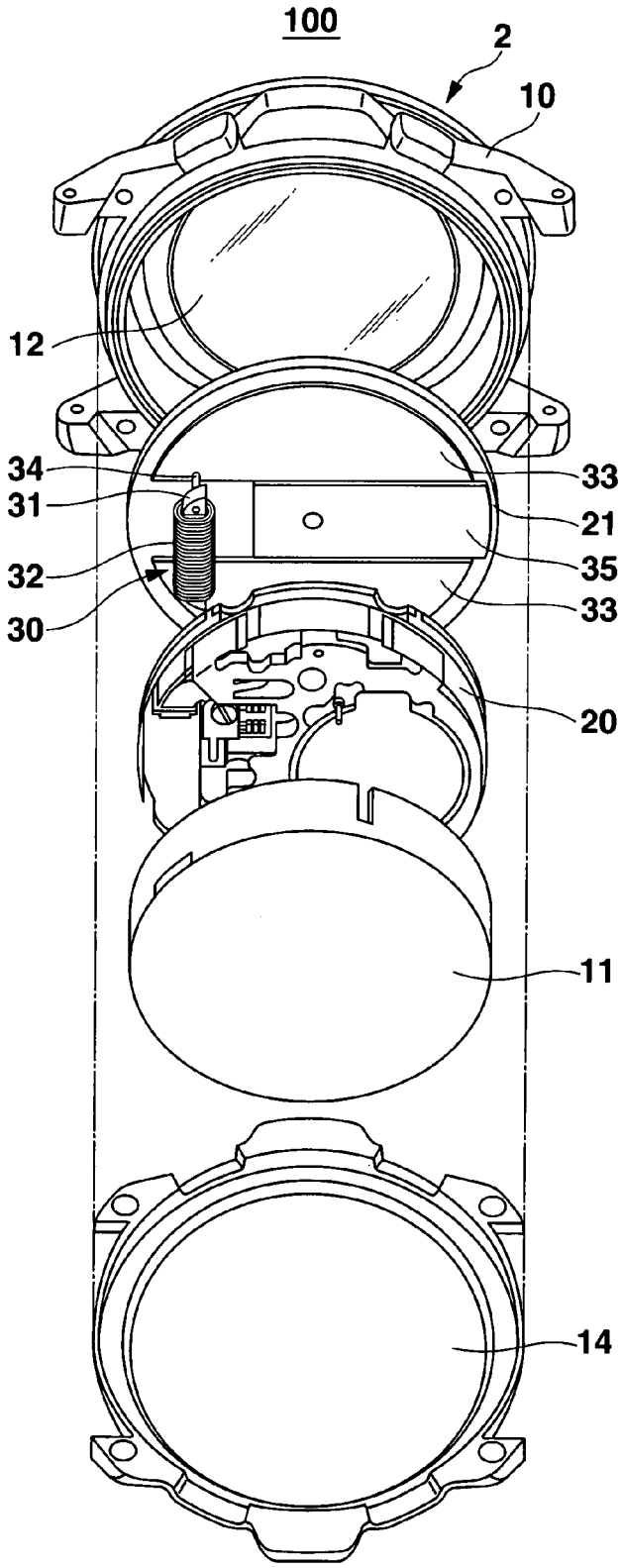
FIG. 2 is an exploded perspective view of the wristwatch of FIG. 1.

As shown in FIGS. 1-3, the body 2 comprises a cylindrical case 10 of metal such as titanium or stainless steel, a top cover such as a crystal 12 which covers the case 10 from above through packing 13, a dial plate 21 provided beneath the crystal 12, and a back cover 14 made of the same material as the case 10 and attached through an O-shaped ring 15 to the bottom of the case 10.

The case 10 encases a second non-magnetic synthetic resin case 11 therein which in turn encases a housing 20 made of the same material as the second case 11 disposed beneath the dial plate 21. The housing 20 has therein attached an antenna device 30 that receives a standard time and frequency signal, an analog hand mechanism 40, and motors M1, M2 and M3 (FIG. 4) which drive the analog hand mechanism 40, and a circuit board (not shown) connected to these elements and having thereon a reception control circuit 600 which controls the antenna device 30 and the analog hand mechanism 40.

Figure 6:
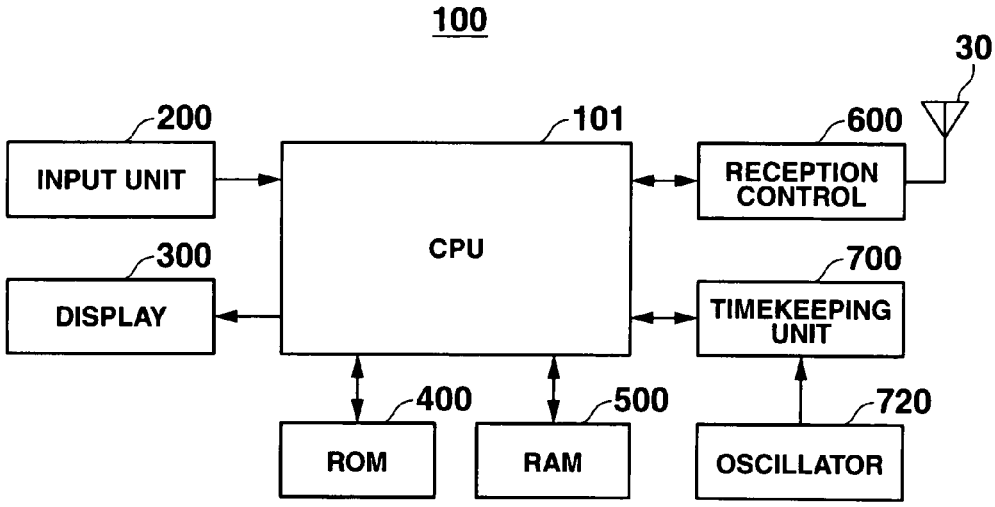
FIG. 6 is an electrical block diagram of the wristwatch of FIG. 1.

The analog hand mechanism 40 includes a shaft 1 extending upward through a center of the dial plate 21 and hour, minute and second hands 22 attached to the shaft driven above the dial plate 21 by the motors M1, M2 and M3, respectively, through the hand mechanism 40. The circuit board is connected electrically to the hand mechanism 40 and has thereon formed a control IC including a CPU; a timekeeping circuit 700 which keeps time and provides the current time with the aid of an oscillator 720, etc., in addition to the reception control circuit 600, as shown in FIG. 6. The reception control circuit 600 amplifies and detects a signal received by the antenna device 30 and extracts time codes included in the signal. The control IC sets the timekeeping circuit 700 in accordance with the time codes to control the analog hand mechanism 40 so as to cause the hands 22 to indicate the correct current time.

Figure 4:
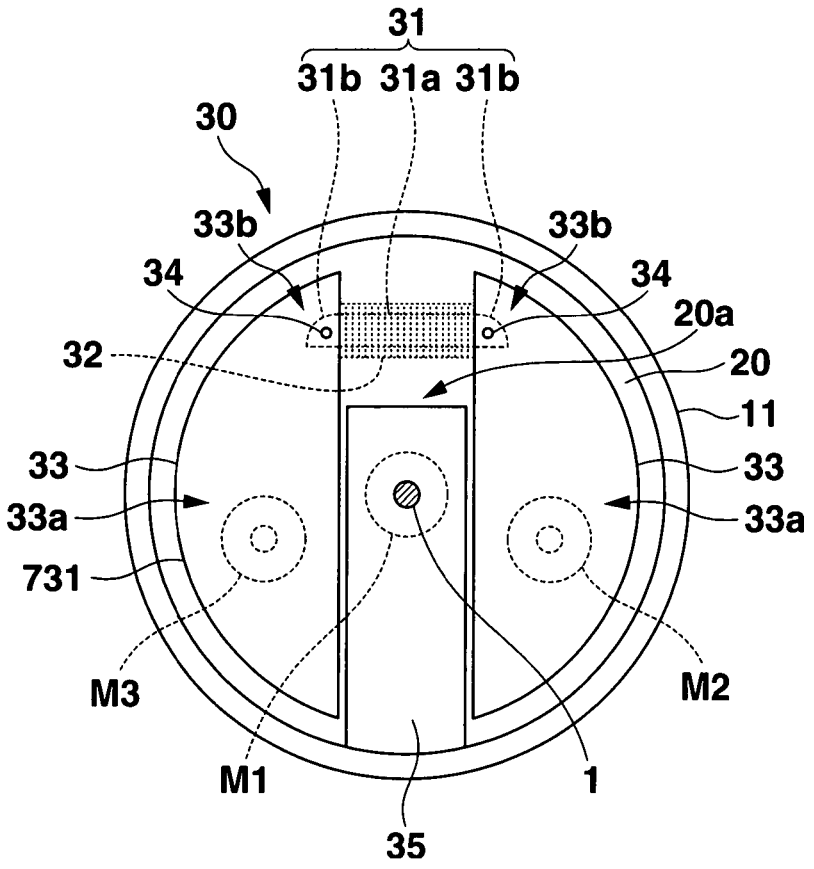
FIG. 4 is a plan view of an antenna device disposed within the wristwatch of FIG. 1.
Figure 5:
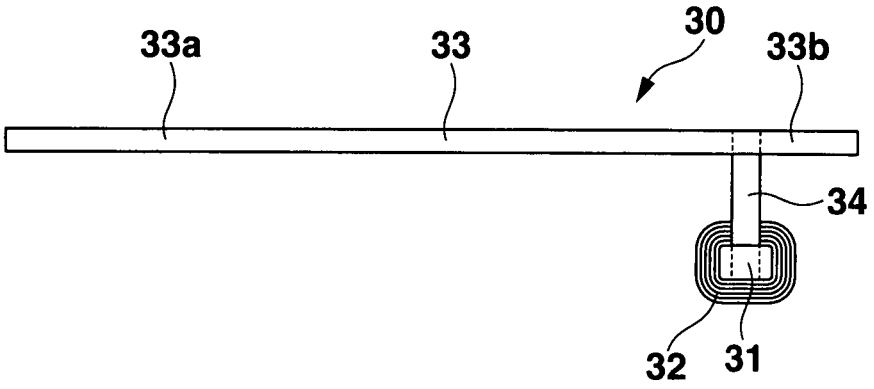
FIG. 5 is a side view of the antenna device of FIG. 4.

As shown in FIGS. 1-5 and more particularly FIG. 4, the antenna device 30 comprises a rod-like magnetic core 31, a coil 32 wound around the core 31, and a pair of thin substantially semicircular magnetic members 33 each attached at one end to a respective end of the core 31 so as to be disposed symmetrical with respect to the hand shaft 1.

The core 31 comprises a coil bearing part 31*a* around which the coil is wound and a pair of coil-free parts 31*b* each protruding outward from a respective end of the bearing part 31*a*. The core 31 is composed of a laminate of a high permeability material, for example, of ferrite, Permalloy (registered trademark) or an amorphous magnetic material.

The pair of substantially semicircular external magnetic members 33 is fixed above housing 20. Each magnetic member comprises a magnetic flux collection part 33*a* which collects magnetic flux of the radio waves and which also screens out external magnetism which would otherwise influence the motors, and a connection part 33*b* which is magnetically connected at one end by a magnetic connection member or screw 34 to a respective one of the coil-free parts 31*b* of the core 31. The pair of semi-circular magnetic members 33 each is made of the same material as the core 31. The two motors M2 and M3 (FIG. 4) are disposed within the housing 20 beneath the external magnetic members 33, respectively.

A thin rectangular anti-magnetic plate 35 made of a magnetic material having a lower permeability than the pair of external magnetic members 33 is provided in a stabilized manner above the motor M1 and on top of the housing 20 between the pair of external magnetic members 33. The pair of external members 33 is magnetically and spatially separated by a part 20*a* of the non-magnetic housing 20 so as not to be in contact with each other. The pair of external members 33 and the anti-magnetic member 35 are supported in a stabilized manner above the housing 20. A horizontal gap is provided between the anti-magnetic plate 35 and each of the pair of external magnetic members 33 for magnetic separation.

FIG. 6 is a block diagram of an electric circuit of the wristwatch 100. As shown, the wristwatch 100 comprises the CPU 101, an input unit 200, a display unit 300, a ROM 400, a RAM 500, the reception control circuit 600, the timekeeping circuit 700, and the oscillator 720.

The CPU 101 reads a program stored in the ROM 400 at predetermined times or in accordance with operation signals from the input unit 200, loads the program on the RAM 500, and then gives commands or transfers data to the respective elements concerned of the wristwatch 100 in accordance with the program. More particularly, for example, the CPU 101 controls the reception control circuit 600 at predetermined intervals of time to cause the same to receive the standard time and frequency signal, sets the timekeeping circuit 700 in accordance with the received signal, and causes the display 300 to display the corrected current time provided by the timekeeping circuit 700.

The input unit 200 comprises the switches 3 which give commands to perform their respective functions concerned in the wristwatch 100. When one of the switches 3 is operated, a corresponding operation signal is outputted to the CPU 101.

The display unit 300 comprises the dial plate 21 and the analog hand mechanism 40 which will be controlled by the CPU 101, and displays the current time kept by the timekeeping circuit 700.

The ROM 400 has stored a system program, application programs, and programs and data which causes the wristwatch to perform its own functions.

The RAM 500 is used as a working area for the CPU 101 and temporarily stores programs/data read from the ROM 400, and the data processed by the CPU 101.

The reception control circuit 600 cuts off unnecessary frequency components from the signal received by the antenna device 30 to provide a desired frequency signal, which is converted to another signal, which is then delivered to the CPU 101.

The timekeeping circuit 700 keeps time by counting clock pulses received from the oscillator 720 to provide the current time data to the CPU 101. The oscillator 720 provides clock pulse signals of a predetermined frequency.

Operation of the antenna device 30 of this embodiment will be described next.

The pair of external magnetic members 33 of the antenna device 30 is magnetically coupled to the respective coil-free parts 31*b* of the core 31 so as to cover wide areas in the wristwatch on the sides of both the core ends, as described above. Thus, the pair of external members 33 collects the magnetic flux of the standard time and frequency signal and cause the magnetic flux to pass through the core 31, thereby inducing an electromotive force across the coil 32. This leads to reception of the standard time and frequency signal. The pair of external members 33 also covers the motors M2 and M3 to cause the external magnetism to be difficult to reach the motors M2 and M3, thereby reducing an influence of the external magnetism on these motors.

The anti-magnetic plate 35 covers the motor M1 so as to screen out the external magnetism, thereby reducing the influence of the external magnetism on the motor M1.

As described above, according to this embodiment, the pair of external magnetic members 33 provided at both the respective ends of the core 31 collect the magnetic flux of the standard signal well in a drawing manner and causes the same to pass through the core, thereby improving the accuracy and sensitivity of the reception. The pair of external magnetic members also screens out external magnetism to reduce its influence on the motors M2 and M3, thereby improving the time accuracy.

The anti-magnetic plate 35 covers the motor M1 which cannot be covered by the pair of external members 33. Thus, the influence of the external magnetism on the motor M1 is reduced, thereby improving the time accuracy.

Thus, the wristwatch 100 with the antenna 30 screens out undesirable external magnetism, improves the reception accuracy of the standard time and frequency signal and maintains high watch accuracy.

Modification

Only the points where the modification is different from the embodiment 1 will be mainly described.

Figure 7:
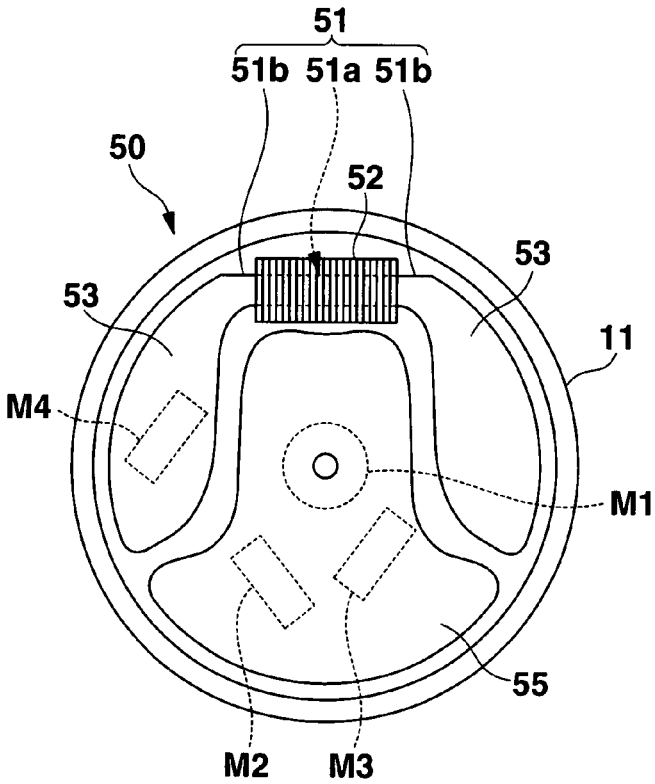
FIG. 7 is a plan view of an antenna device as a modification 1 of the embodiment 1.

Referring to FIG. 7, the modification is shown which comprises motors M1-M4 which drive an analog hand mechanism 40, an antenna device 50 and an anti-magnetic plate 55 provided within the housing 20. The motor is used to drive a pointer of a temperature sensor (not shown).

Figure 8A:
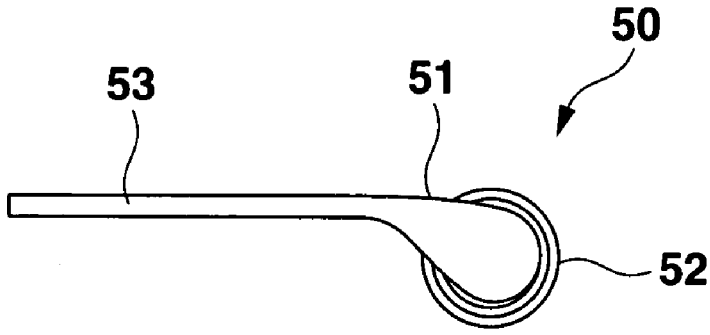
FIG. 8A is a side view of the antenna device of FIG. 7.
Figure 8B:
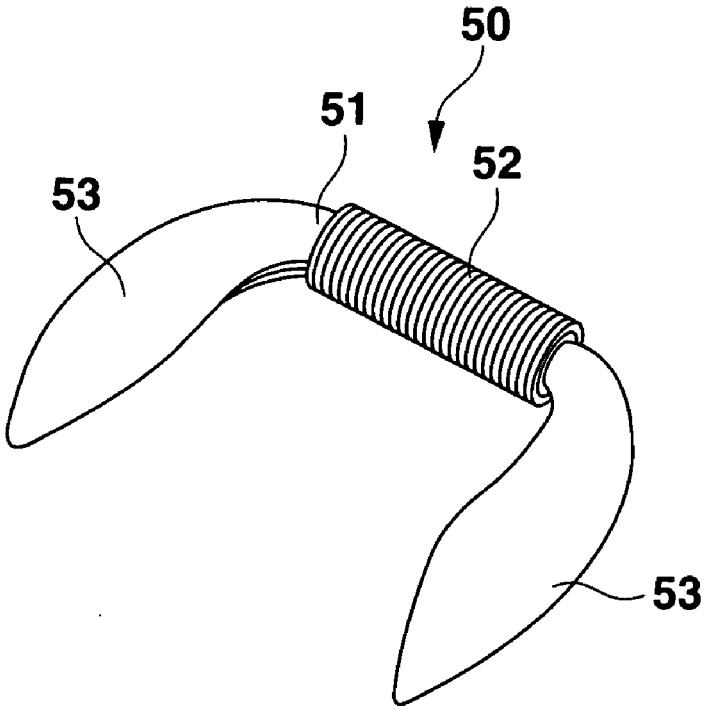
FIG. 8B is a perspective view of the antenna device of FIG. 8A.

As shown in FIGS. 7, 8A and 8B, the antenna device 50 comprises a magnetic body 51 and a coil 52 wound around the magnetic body 51. The magnetic body 51 comprises a coil bearing part 51*a* around which the coil 52 is wound, and a pair of outward protruding coil-free parts 51*b* each integrally including a rabbit ear-shaped extension 53, for example, of the same material as the core to collect the magnetic flux of the standard time and frequency signal. The left-hand extension 53 also screens out external magnetism which would otherwise influence the motor M4 disposed therebelow. The pair of extensions 53 is in the form of a thin plate excluding the coil bearing part of the magnetic body 51.

A substantially T-shaped thin anti-magnetic plate 55 of a lower permeability than the pair of extensions 53 is provided between the pair of extensions 53 to cover the motors M1, M2 and M3 within the housing 20 so as to reduce the influence of the external magnetism on these motors. A horizontal gap is provided having a width enough to ensure magnetic separation between the anti-magnetic plate 55 and each of the pair of extensions 53. In the antenna device 50, the magnetic flux of the standard time and frequency signal collected by the pair of extensions 53 pass through the coil bearing part 51*a* of the magnetic body.

The left-hand extension 53, which forms a part of the left-hand coil-free part 51*b*, covers the motor M4 to screen out the external magnetism which would otherwise influence the motor M4. Likewise, the anti-magnetic plate 55 covers the motors M1-M3 to screen out external magnetism which would otherwise influence the motors M1-M3.

Thus, the antenna device 50 provides improved reception accuracy and sensibility. Furthermore, the left-hand extension 53 and anti-magnetic plate 55 screen out external magnetism to reduce the influence of the magnetism on the motors M4 and M1-M3, respectively, thereby improving the watch accuracy.

Figure 9A:
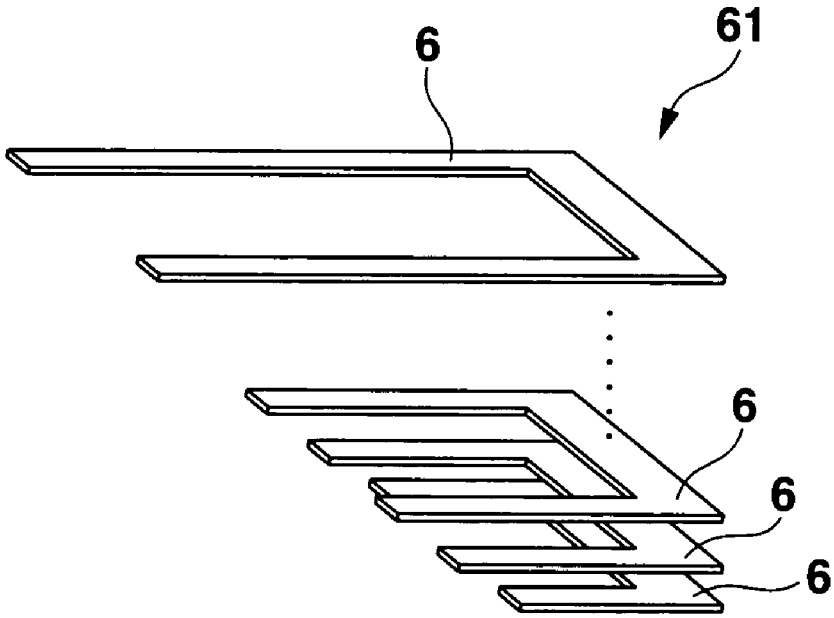
FIG. 9A is an exploded view of a core of a modification of the antenna device of FIG. 1.
Figure 9B:
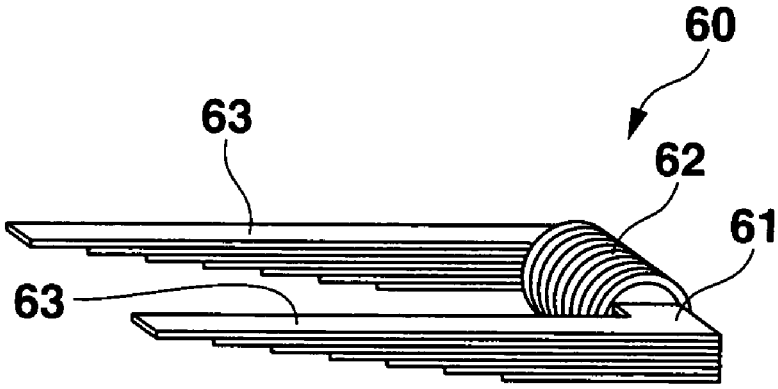
FIG. 9B is a perspective view of the modification of FIG. 9A.

The shape of the antenna device of the modification is not limited to the above embodiment. For example, as shown in FIGS. 9A and 9B, the antenna device 60 may comprise a substantially U-like magnetic core 61 and a coil 62 wound around the base of the magnetic body 61. As shown in FIG. 9A, the magnetic body 61 is made of a laminate of substantially U-shaped thin magnetic pieces 6 whose branches are shortened downward, or thinned toward an end thereof. This antenna structure also serves to improve the reception accuracy and sensibility of the standard signal.

Embodiment 2

The points where a wristwatch 200 as an embodiment 2 of the present invention is different from the embodiment 1 will mainly be described.

Figure 10:
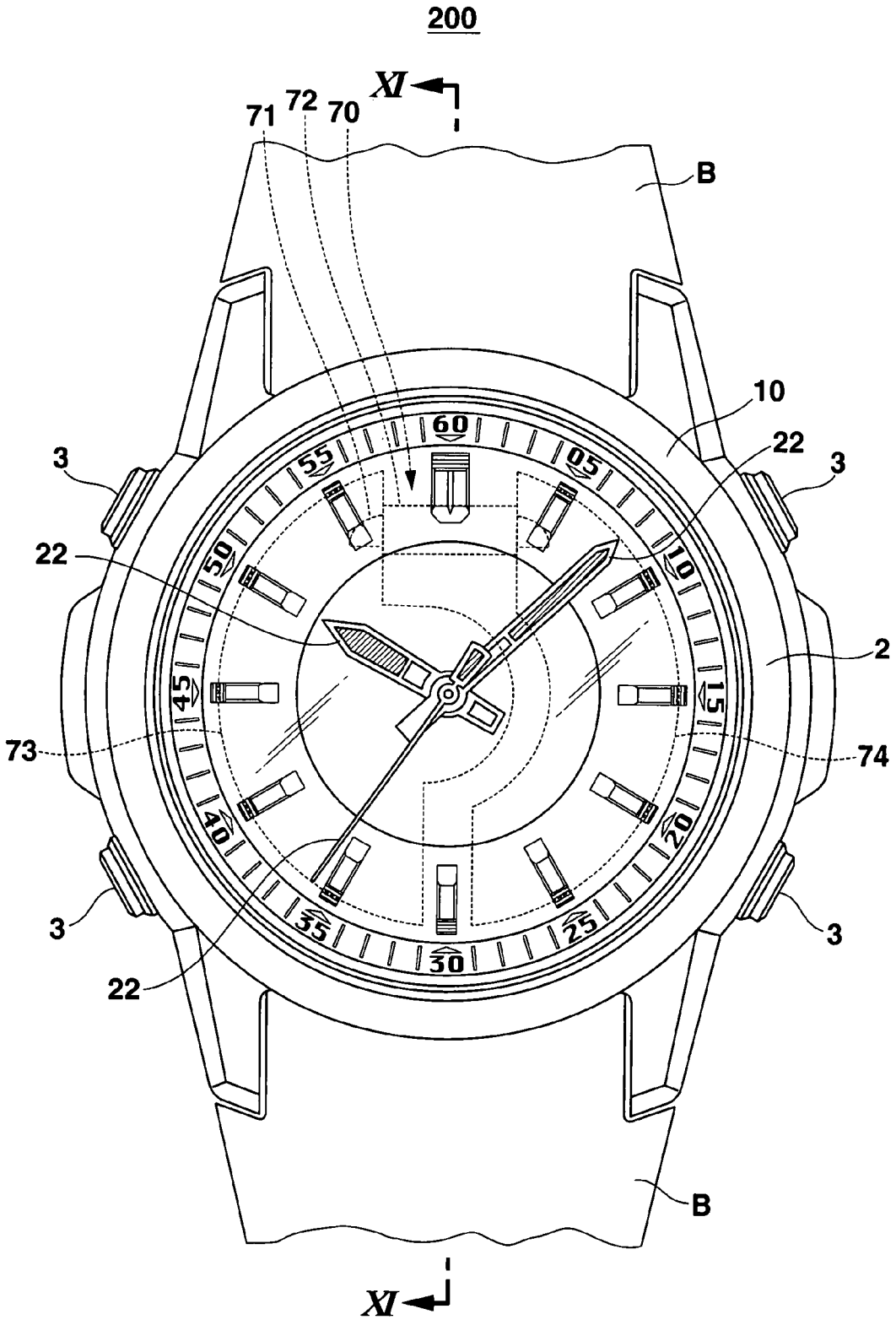
FIG. 10 is a front view of a wristwatch as a second embodiment 2 of the present invention.
Figure 11:
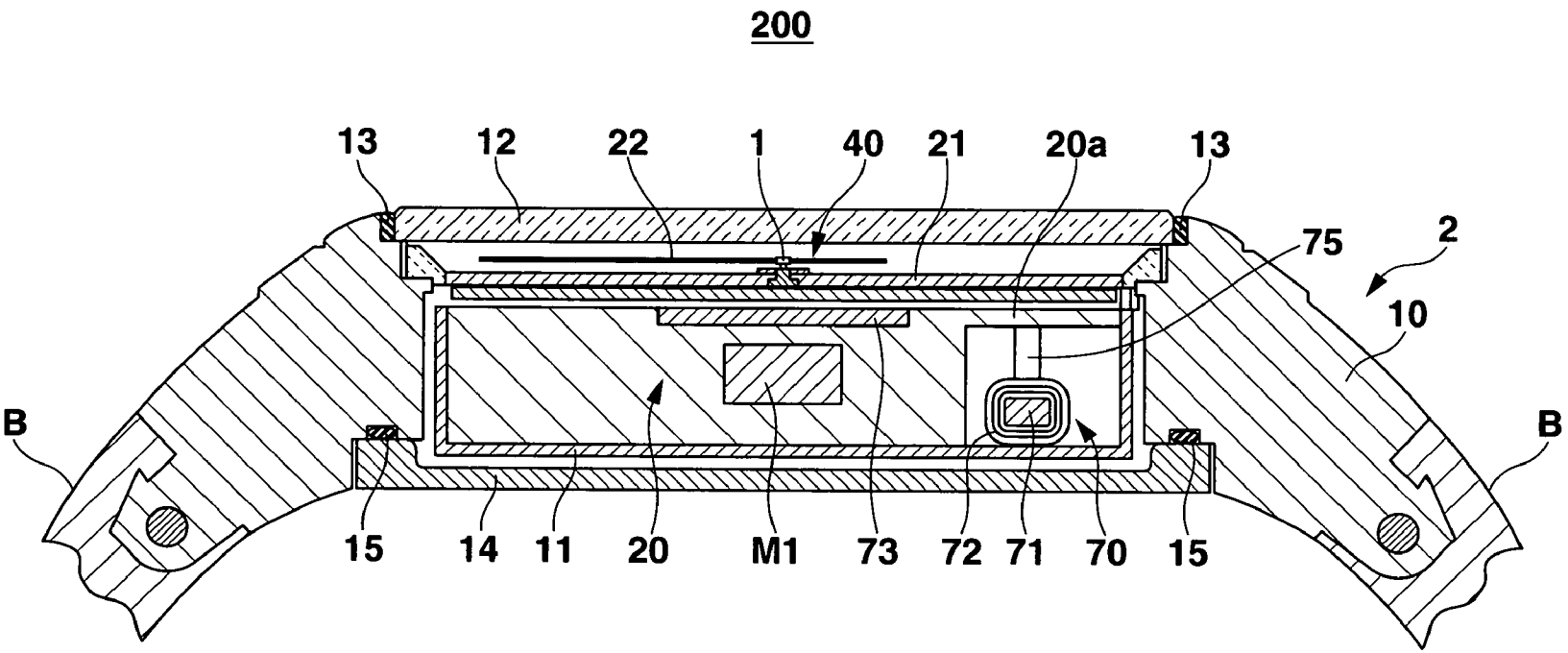
FIG. 11 is a cross section view taken along a line XI-XI of FIG. 10.
Figure 12:
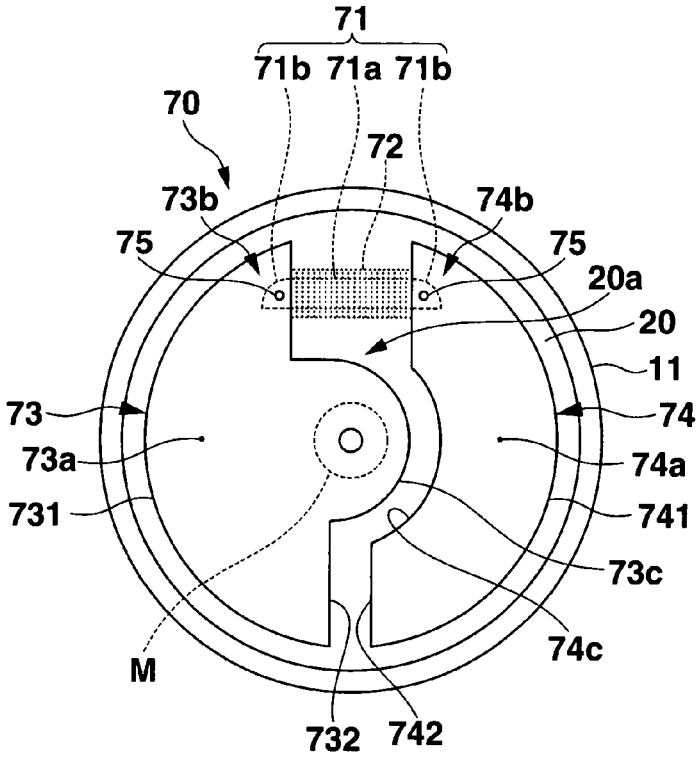
FIG. 12 is a plan view of an antenna device disposed within the wristwatch of FIG. 10.

As shown in FIGS. 10-12, the wristwatch 200 has a body 2 with a band B whose ends are attached to the opposite ends of the body.

As shown in FIG. 11, the body 2 comprises a cylindrical case 10, a top cover such as a crystal 12 which covers the case 10 from above, a dial plate 21 provided beneath the crystal 12, and a back cover 14 and attached to the bottom of the case 10.

The case 10 encases a second non-magnetic synthetic resin case 11 therein which in turn encases a housing 20 made of the same material as the second case 11 disposed beneath the dial plate 21. The housing 20 has thereto attached an antenna device 70 that receives the standard time and frequency signal, an analog hand mechanism 40, a motor M which drives the analog hand mechanism 40, and a circuit board (not shown) connected to these elements. The circuit board has thereon formed a reception control circuit 600, which controls the antenna device 70 and the analog hand mechanism 40, and other elements such as described with respect to the embodiment 1.

As shown in FIGS. 10-12, the antenna device 70 comprises a magnetic core 71, a coil 72 wound around the core 71, and a first and a second thin substantially semicircular external magnetic member 73 and 74 provided at respective ends of the core 71.

The core 71 comprises a coil bearing part 71*a* around which a coil 72 is wound and a pair of outward protruding coil-free parts 71*b* around which no coils are wound. The core 71 has the same shape as and is made of the same magnetic material as the core 31 of the first embodiment.

The first semicircular external magnetic member 73, which is delimited by an arc 731 and a chord 732, has a central semicircular convexity 73*c* on the chord which screens out external magnetism which would otherwise influence the motor M provided beneath the semicircular convexity. The magnetic member 73 also is connected magnetically at one (connection) end 73*b* by a magnetic connection member or screw 75 to a left-hand part 71*b* of the core. The second semicircular external magnetic member 74, which is delimited by an arc 741 and a chord 742, has a central substantially semicircular concavity 74*c* on the chord 742 which receives the convexity 73*c* of the first magnetic member 73 partly and is connected at one (connection) end 74*b* to a right-hand part 71*b* of the core by a magnetic connection member or screw 75. The first and second magnetic members 73 and 74 are made of the same material as and the same function as the magnetic members 33 of the first embodiment and have magnetic flux collecting parts 73*a* and 74*a* which collect the magnetic flux of the received radio waves.

The housing 20 has a non-magnetic part 20*a* sufficient to separate the first and second magnetic members 73 and 74 magnetically and spatially.

The antenna device 70 of this embodiment also provides improved reception accuracy and sensitivity. Since the first magnetic member 73 screens out the external magnetism, the influence of the external magnetism on the motor M1 is reduced and the time accuracy is improved. Thus, the wristwatch 200 with the antenna device 70 screens out undesirable external magnetism and improves the reception accuracy of the standard time and frequency signal and the watch accuracy.

Modification 2-1

Only the points where the modification 2-1 is different from the embodiment 2 of FIG. 12 will mainly be described.

Figure 13:
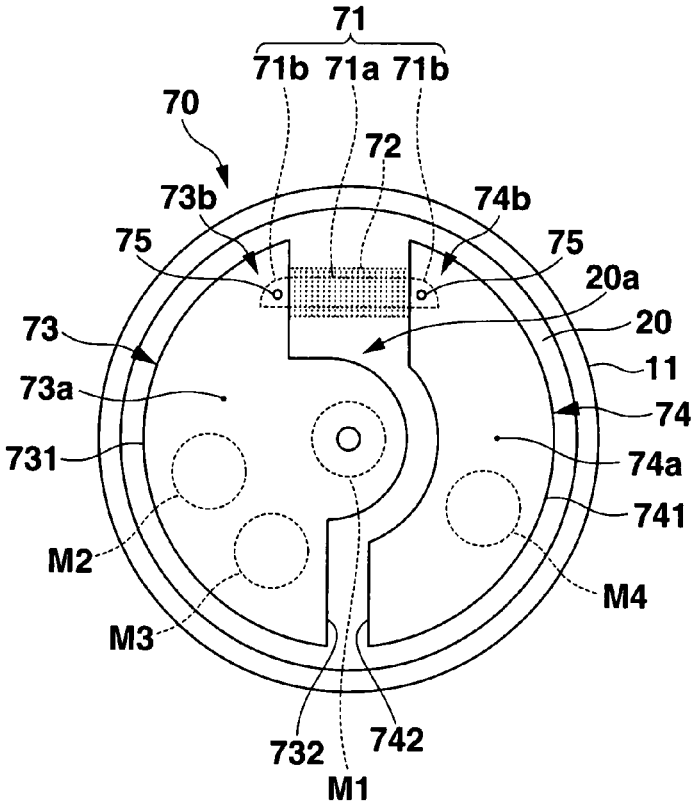
FIG. 13 is a plan view of a modification of the antenna device of FIG. 10.

Referring to FIG. 13, a wristwatch as the modification 2-1 of the embodiment 2 includes motors M1, M2 and M3 beneath the first external magnetic member 73 within the housing 20. Another motor M4 is provided beneath the second external magnetic member 74.

Thus, the first and second external magnetic members 73 and 74 collect the magnetic flux of the standard time and frequency signal in a sharing manner and screens out external magnetism which would otherwise influence the respective motors M1-M4, thereby improving the time accuracy.

Modification 2-2

Only the points where the modification 2-2 is different from the modification 2-1 will mainly be described.

Figure 14:
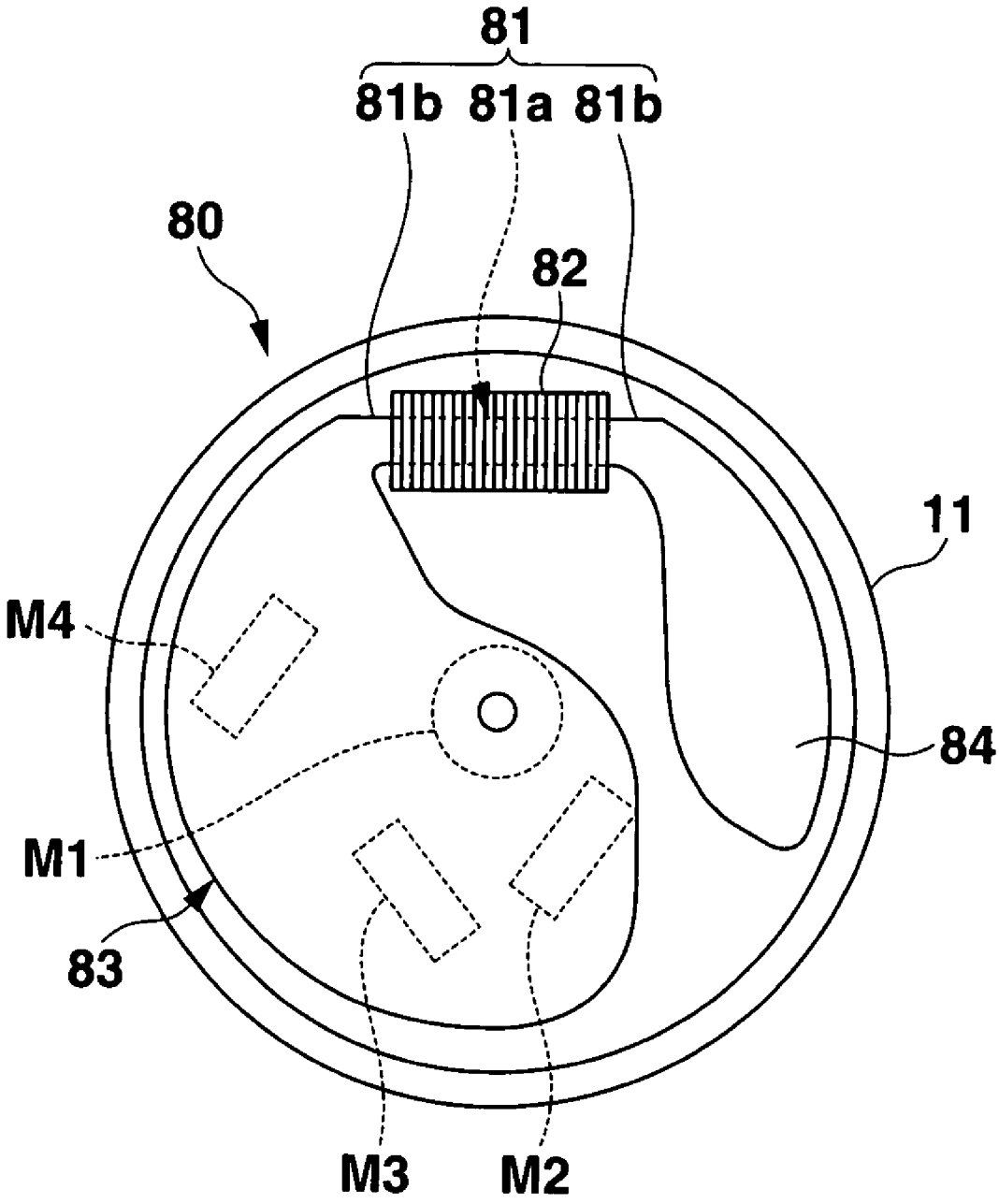
FIG. 14 is a plan view of a second modification of the antenna device of FIG. 10.

Referring to FIG. 14, the second modification 2-2 includes motors M1-M4, and an antenna device 80 provided within the housing 20.

As shown in FIG. 14, the antenna device 80 comprises a magnetic body 81 and a coil 82 wound around the body 81. The magnetic body 81 comprises a coil bearing part 81*a* around which the coil 82 is wound and a pair of outward protruding coil-free parts 81*b*. The magnetic body 81 has a larger and a smaller rabbit ear-shaped magnetic extension 83 and 84 integral with the left- and right-hand coil-free parts thereof, respectively, for collecting external magnetic flux of the standard time and frequency signal. The larger extension 83 also covers the motors M1-M4 so as to screen out the external magnetism which would otherwise influence these motors, thereby improving the watch accuracy. The magnetic body 81 and the extensions 83, 84 are made of the same material as the core of the modification 2-1.

The antenna device 80 of this modification also improves the reception accuracy and sensitivity of the standard time and frequency signal. The extension 83 screens out external magnetism which would otherwise influence the motors M1-M4, thereby improving the watch accuracy.

SUMMARY OF THE EMBODIMENTS AND MODIFICATIONS

The structures and advantages of the embodiments and their modifications of the present invention will be summarized as follows:

In one embodiment, an electronic apparatus comprises, within a body, at least one motor and an antenna device that comprises a magnetic body and a coil wound around the magnetic body. The electronic apparatus is characterized in that the magnetic body comprises a coil-bearing part around which the coil is wound, and a pair of coil-free parts each protruding outward from a respective one of ends of the coil bearing part; and at least one of the pair of coil-free parts including an extension for screening out external magnetism which would otherwise influence the at least one motor and for collecting magnetic flux of external radio waves.

According to this embodiment, the extension of at least one end of the antenna core screens out undesirable external magnetism which would otherwise adversely influence the motor, thereby improving the watch accuracy. The extension also collects magnetic flux of the standard time and frequency signal in a drawing manner so as to pass well through the magnetic body, thereby improving the reception accuracy and sensitivity of the radio waves.

In this case, the extension may be integral with that coil-free end part.

In another embodiment, an electronic apparatus comprises at least one motor and an antenna device that comprises a magnetic core having a pair of ends and a coil wound around the core between its pair of ends. The electronic apparatus is characterized in that the core has, at least one of the pair of ends, an external magnetic member including a connection part connected magnetically to that end and a flux collecting part that collects the magnetic flux of external radio waves and that screens out external magnetism which would otherwise influence the at least one motor.

According to this embodiment, the external magnetic member connected to the at least one end of the antenna core screens out undesirable external magnetism which would otherwise adversely influence the motor, thereby improving the apparatus accuracy. The external magnetic member also collects magnetic flux of the standard time and frequency signal in a drawing manner so as to pass well through the magnetic core, thereby improving the reception accuracy and sensibility of the signal.

In this case, the external magnetic member may be provided as a separate one at the end of the core.

A housing may be provided within the body for fixing the motor and the antenna device therein. The external magnetic member may be provided on top of the housing.

In this embodiment, when the core has a pair of external magnetic members each at a respective one of the pair of ends thereof, the housing may comprise a non-magnetic part that separates the two external magnetic members magnetically and spatially.

In this embodiment, the body may comprise: a cylindrical case that encases the housing; an upper cover that covers the upper end of the case; and a lower cover that covers the lower end of the case. The external magnetic member(s) may be disposed between the motor and the upper cover.

In this embodiment, the external magnetic member(s) may be connected at its connection part to the core by a magnetic connection member.

In this embodiment, when the core has a pair of external magnetic members each at a respective one of the pair of ends thereof, and the number of the at least one motor is more than one, the pair of external magnetic members may screen out external magnetism in a sharing manner so as not to influence the motors.

In this embodiment, the electronic apparatus may further comprise a further motor, and an anti-magnetic plate provided above the further motor for screening out external magnetism which would otherwise influence the further motor.

In this embodiment, when the core has a pair of external magnetic members each at a respective one of the pair of ends thereof, the apparatus may further comprise a different motor provided between the pair of external magnetic members; and an anti-magnetic plate for screening external magnetism which would otherwise influence the different motor.

In one embodiment, an electronic timepiece comprises an analog hand mechanism, a motor for driving the hand mechanism, and an antenna device that comprises a magnetic core and a coil wound around the core. The electronic timepiece is characterized in that the antenna device comprises an external magnetic member having a connection part connected magnetically to an end of the core, and a magnetic flux collecting part disposed so as cover the motor for screening out external magnetism which would otherwise influence the motor and for collecting the flux of external radio waves.

Thus, according to this embodiment, the influence of the external magnetism on the motor is reduced by the external magnetic member, thereby improving the time accuracy of the timepiece. The external magnetic member collects the external magnetic flux of radio waves well in a drawing manner to cause the same to pass through the core, thereby improving the reception accuracy and sensibility of the radio waves.

While in the above embodiments the housing is illustrated as made of a non-magnetic material, the present invention is not limited to this particular case. For example, areas of a magnetic material may be formed in an inserting or hooping manner on a non-magnetic housing or a housing of magnetic and non-magnetic materials may be formed such that the areas of a magnetic material may be used as the external magnetic members.

While in the embodiments the radio-controlled wristwatches are illustrated as electronic apparatus, the present invention is applicable to any electronic apparatus as long as the same has the function to receive radio waves: for example, mobile phones, radios, mobile game devices, digital audio players, etc.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. An electronic apparatus comprising:

at least one motor and an antenna device that comprises a magnetic core having a pair of ends and a coil wound around the core between the pair of ends, wherein at least one of the pair of ends, the core has an external magnetic member including a connection part connected magnetically to said end and a flux collecting part that collects the magnetic flux of external radio waves and that covers the at least one motor to screen the at least one motor from external magnetism which would otherwise influence the at least one motor;

wherein the external magnetic member is provided as a separate member at the end of the core.

2. An electronic apparatus comprising:

at least one motor and an antenna device that comprises a magnetic core having a pair of ends and a coil wound around the core between the pair of ends, wherein at least one of the pair of ends, the core has an external magnetic member including a connection part connected magnetically to said end and a flux collecting part that collects the magnetic flux of external radio waves and that covers the at least one motor to screen the at least one motor from external magnetism which would otherwise influence the at least one motor;

a housing provided within a body of the electronic apparatus for fixing the motor and the antenna device therein; and wherein the external magnetic member is provided on top of the housing.

3. The electronic apparatus of claim 2, wherein:

when the core has a pair of external magnetic members each at a respective one of the pair of ends thereof, the housing comprises a non-magnetic part that separates the two external magnetic members magnetically and spatially.

4. The electronic apparatus of claim 2, wherein the body comprises:

a cylindrical case that encases the housing;

an upper cover that covers an upper end of the case; and a lower cover that covers a lower end of the case, wherein the external magnetic member is disposed between the motor and the upper cover.

5. An electronic apparatus comprising:

at least one motor and an antenna device that comprises a magnetic core having a pair of ends and a coil wound around the core between the pair of ends, wherein at least one of the pair of ends, the core has an external magnetic member including a connection part connected magnetically to said end and a flux collecting part that collects the magnetic flux of external radio waves and that covers the at least one motor to screen the at least one motor from external magnetism which would otherwise influence the at least one motor;

a further motor; and an anti-magnetic plate provided above the further motor for screening out external magnetism which would otherwise influence the further motor.

6. An electronic apparatus comprising:

at least one motor and an antenna device that comprises a magnetic core having a pair of ends and a coil wound around the core between the pair of ends, wherein at least one of the pair of ends, the core has an external magnetic member including a connection part connected magnetically to said end and a flux collecting part that collects the magnetic flux of external radio waves and that covers the at least one motor to screen the at least one motor from external magnetism which would otherwise influence the at least one motor;

wherein when the core has a pair of external magnetic members each at a respective one of the pair of ends thereof, the apparatus further comprises:

a different motor provided between the pair of external magnetic members; and an anti-magnetic plate for screening external magnetism which would otherwise influence the different motor.

* * * * *

UNITED STATES PATENT AND TRADEMARK OFFICE

CERTIFICATE OF CORRECTION

PATENT NO. : 7,777,680 B2
APPLICATION NO. : 11/904331
DATED : August 17, 2010
INVENTOR(S) : Kazuaki Abe and Soh Kimura It is certified that error appears in the above-identified patent and that said Letters Patent is hereby corrected as shown below:

Delete the title page showing an illustrative figure, and substitute the attached title page therefor.

On the title page:

Under Item (75) Inventors:, lines 1-2, delete "Kaoru Someya, Kiyose (JP);"

Signed and Sealed this
Fifth Day of April, 2011

David J. Kappos

David J. Kappos
*Director of the United States Patent and Trademark Office*

(12) United States Patent
Abe et al.

(10) Patent No.: US 7,777,680 B2
(45) Date of Patent: Aug. 17, 2010

(54) ELECTRONIC APPARATUS AND TIMEPIECE

(75) Inventors: Kazuaki Abe, Iruma (JP); Kaoru Someya, Kiyose (JP); Soh Kimura, Kodaira (JP)

(73) Assignee: Casio Computer Co., Ltd., Tokyo (JP)

( * ) Notice: Subject to any disclaimer, the term of this patent is extended or adjusted under 35 U.S.C. 154(b) by 224 days.

(21) Appl. No.: 11/904,331

(22) Filed: Sep. 26, 2007

(65) Prior Publication Data

US 2008/0080320 A1 Apr. 3, 2008

(30) Foreign Application Priority Data

Sep. 29, 2006 (JP) ..... 2006-267790
Dec. 28, 2006 (JP) ..... 2006-354401
Jun. 28, 2007 (JP) ..... 2007-170527

(51) Int. Cl.
*H01Q 1/12* (2006.01)
*H01Q 7/08* (2006.01)

(52) U.S. Cl. ..... 343/718; 343/788

(58) Field of Classification Search ..... 343/787, 343/788, 718

See application file for complete search history.

(56) References Cited

U.S. PATENT DOCUMENTS 5,253,226 A 10/1993 Ganter
6,927,739 B2 * 8/2005 Nomura et al. ..... 343/788
7,274,337 B2 * 9/2007 Takakura ..... 343/788
7,280,438 B2 * 10/2007 Fujisawa ..... 368/47
7,511,679 B2 * 3/2009 Araki et al. ..... 343/788
2006/0066498 A1 3/2006 Abe et al.
2008/0007474 A1 1/2008 Abe et al.

FOREIGN PATENT DOCUMENTS

DE 39 41 913 C1 2/1991
DE 91 11 096.3 U1 1/1993
DE 44 07 116 A1 9/1995
JP 2004-294258 A 10/2004

OTHER PUBLICATIONS

Extended European Search Report dated Oct. 2, 2009 issued in counterpart European Appln. No. 07 01 8858.

* cited by examiner

*Primary Examiner*—Hoang V Nguyen
(74) *Attorney, Agent, or Firm*—Frishauf, Holtz, Goodman & Chick, P.C.

(57) ABSTRACT

In an antenna device of a wristwatch, a pair of external magnetic members each attached to a respective one of both ends of a magnetic core effectively collects the magnetic flux of a standard time and frequency signal. The collected magnetic flux passes through the core around which a coil is wound, thereby inducing an electromotive force and hence improving the reception accuracy of the signal. The pair of external magnetic members screens out undesirable external magnetism which would otherwise influence motors that drive a hand shaft and hands, thereby achieving accurate hand driving and improving the high watch accuracy.

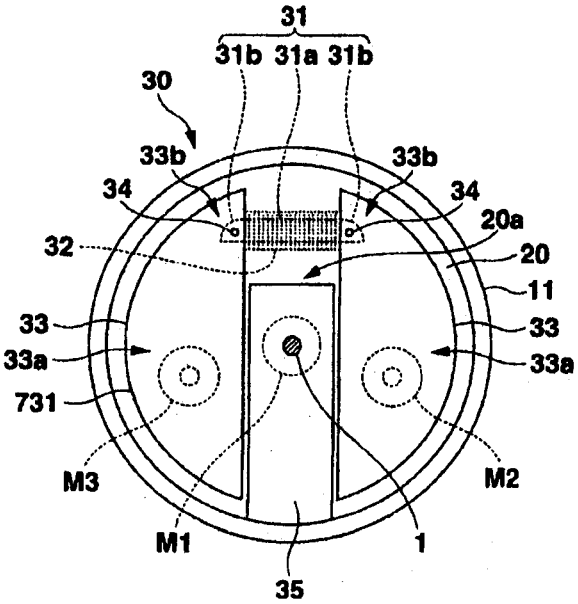

6 Claims, 11 Drawing Sheets